US005969289A

United States Patent [19]

Bisping et al.

[11] Patent Number: 5,969,289

[45] Date of Patent: Oct. 19, 1999

[54] SUBCALIBER PROJECTILE

[75] Inventors: Bernhard Bisping, Ratingen; Jürgen Kolodzey, Fassberg; Wolfgang Stein, Hermannsburg; Alfons Sackarndt, Unterlüss, all of Germany

[73] Assignee: Rhienmetall W& M GmbH, Unterlüss, Germany

[21] Appl. No.: 08/984,533

[22] Filed: Dec. 3, 1997

[30] Foreign Application Priority Data

Dec. 6, 1996 [DE] Germany ..... 196 50 739

[51] Int. Cl.[6] ..... F42B 14/06

[52] U.S. Cl. ..... 102/521

[58] Field of Search ..... 102/520–523

[56] References Cited

U.S. PATENT DOCUMENTS

| | | | |
|---|---|---|---|
| 3,446,147 | 5/1969 | Engel et al. | 102/522 |
| 3,496,869 | 2/1970 | Engel | 102/522 |
| 4,249,466 | 2/1981 | Rossmann et al. | 102/521 |
| 4,476,785 | 10/1984 | Hoffman et al. | 102/522 |
| 5,388,523 | 2/1995 | Rossmann . | |

FOREIGN PATENT DOCUMENTS 1 182 834 3/1970 United Kingdom .

*Primary Examiner*—Harold J. Tudor
*Attorney, Agent, or Firm*—Venable; Norman N. Kunitz

[57] ABSTRACT

A subcaliber projectile, comprising a penetrator (4) and a propelling cage (5, 5') that surrounds at least a midportion of the penetrator, wherein the base region (8) of a cap (7, 7', 7") that is tapered toward the penetrator point (6) is arranged on the propelling cage (8). To achieve, on the one hand, a good and secure feeding during the firing of the projectile with automatic weapons, and, on the other hand, a good hit capability, the inertial forces of the cap (7, 7', 7") during the acceleration of the projectile (2) inside the weapon tube (1) are used to cause a defined disintegration of the cap (7, 7', 7") into segments. For this purpose, the cap (7, 7', 7") is supported in its base region (8) on a surface (9, 9') of the propelling cage (5, 5') that is tapered conically toward the projectile point, such that during the acceleration of the projectile (2) inside the weapon tube (1), the cap (7, 7', 7") is displaced axially in the direction of the propelling cage (5, 5'), which leads to an expansion in the base region (8) of the cap and causes a cracking or breaking of the cap (7, 7', 7") at groove-shaped, predetermined breakage locations (13, 13') of the cap (7, 7', 7") that extend in the direction of the longitudinal axis (12) of the projectile (2).

8 Claims, 1 Drawing Sheet

SUBCALIBER PROJECTILE

BACKGROUND OF THE INVENTION

The invention relates to a subcaliber projectile with a penetrator and a propelling cage or sabot surrounding a portion of the penetrator, and wherein the base region of a cap, that is tapered toward the penetrator point, is arranged on a front end of the propelling cage.

Such projectiles are used, in particular, for firing from automatic weapons, wherein the cap arranged on the front of the propelling cage, which cap is also referred to as a feeding cap, is designed to facilitate the automatic feeding of the respective cartridge into the cartridge chamber of the weapon as well as to protect the point of the penetrator. Providing the cap with groove-shaped, predetermined break locations that extend in the longitudinal direction of the projectile causes a defined cracking open of the feeding cap, in particular with spin-stabilized projectiles, so that the corresponding segments of the feeding cap fly off to the side as soon as the projectile has left the gun tube.

It is furthermore known to provide slots in the point region of the cap, so that the dynamic pressure forming in the weapon gun tube in front of the projectile as a result of the high projectile velocity can also act upon the inside surface of the cap. On leaving the gun tube, the pressure existing on the cap outside can drop rapidly to atmospheric pressure. The pressure on the inside of the cap does not drop as rapidly owing to the comparably small exit cross section and thus acts from the inside upon the cap segments, which are pushed away toward the outside.

In practical operations it has turned out to be a problem that feeding caps, which meet the requirement of a quick and uniform separation when the projectile leaves the muzzle of the gun tube, also disintegrate relatively easily during the feeding operation into the weapon chamber. This can cause considerable malfunctions in the weapon, for which the repair is very time-consuming. On the other hand, the problem with projectiles having caps with a high stability in the region of the predetermined break locations is that the cap separates only slowly and with little relative uniformity after leaving the gun tube, which frequently causes poor hit results.

The object of the present invention is to provide a spin- or fin-stabilized projectile of the above-mentioned type, which, on the one hand, ensures a good and secure feeding during the firing with automatic weapons, and, on the other hand, also has a good hit capability.

SUMMARY OF THE INVENTION

The above object generally is achieved according to the present invention by a subcaliber projectile, which comprises a penetrator having a pointed front end, a propelling cage that surrounds a midportion of the penetrator, and a cap which is tapered conically toward the penetrator point and which has a base region arranged on and surrounding a reduced diameter front portion of the propelling cage; and wherein:

the cap supports itself in its said base region on a surface of the propelling cage that is conically tapered in a direction toward the projectile point, such that during acceleration of the projectile inside a weapon tube from which the projectile is fired, the cap is displaced, as a result of the inertial force, in an axial direction toward the propelling cage, thereby causing an expansion of the diameter of the base region of the cap;

at least two groove-shaped predetermined break locations that extend in the direction of the longitudinal axis of the projectile are provided in the outer conical surface of the cap;

the base region of the cap has an outside diameter which is smaller than the outside diameter of the propelling cage and thus is smaller than the inside diameter of the weapon tube from which the projectile is to be fired; and, the conical angle of the conical surface of the propelling cage and the outside diameter of the base region of the cap are selected such that the expansion occurring in the base region of cap during acceleration of the projectile inside the weapon tube causes a cracking of the cap along the predetermined break locations. Further advantageous features and embodiments of the invention are disclosed and described below.

The invention essentially is based on the idea of utilizing the inertial forces of the cap during the acceleration of the projectile in the weapon tube for a defined disintegration or separation of the cap into segments. For this purpose, the cap is supported in its base region on a surface of the propelling cage, which is tapered conically toward the projectile point, in such a way that during an acceleration of the projectile in the weapon tube, the cap is displaced axially in the direction of the propelling cage, which results in an expanding of the base region of the cap and causes a cracking of the cap at the groove-shaped predetermined break locations on the cap that extend in the direction of the longitudinal axis of the projectile. For cartridges not yet fired, this base region of the cap must have an outside diameter or caliber smaller than the inside diameter or caliber of the weapon tube, and thus of the outside diameter of the propelling cage, so that the cap can expand correspondingly in the base region.

According to one embodiment of the invention, the conical surface of the propelling cage is an end surface defining an end of the reduced diameter portion of the propelling cage, and the cap has an end surface that faces the propelling cage and supports the cap on the conical end surface of the propelling cage. The end surface of the cap that is facing the propelling cage may be a conical surface that matingly engages the conical end surface of the propelling cage, or radially extending surface that contacts the facing conical end surface of the propelling cage at a lower edge of the end surface of the cap.

According to a particularly advantageous embodiment of the invention, the cone-shaped surface of the propelling cage is arranged on a reduced diameter circumferential or outer surface of the propelling cage and engages a similarly tapered surface on the inside surface of the jacket of the cap. The rear end of the cap has a fastening nub pointing toward the longitudinal axis of the projectile for attaching the cap to the propelling cage, with this nub extending behind the cone-shaped surface of the propelling cage and engaging in a corresponding groove-shaped recess in the reduced diameter outer surface of the propelling cage. The width of the groove-shaped recess in this surface of the propelling cage is selected such that it permits an axial displacement of the cap during the acceleration of the projectile in the weapon tube, which axial movement is sufficient to cause a cracking of the cap along the predetermined break locations caused by the expansion of the base region of the cap.

Further details and advantages of the invention follow from the following embodiments, which are explained with the aid of the figures.

DETAILED DESCRIPTION OF THE PREFERRED EMBODIMENT

Figure 1:
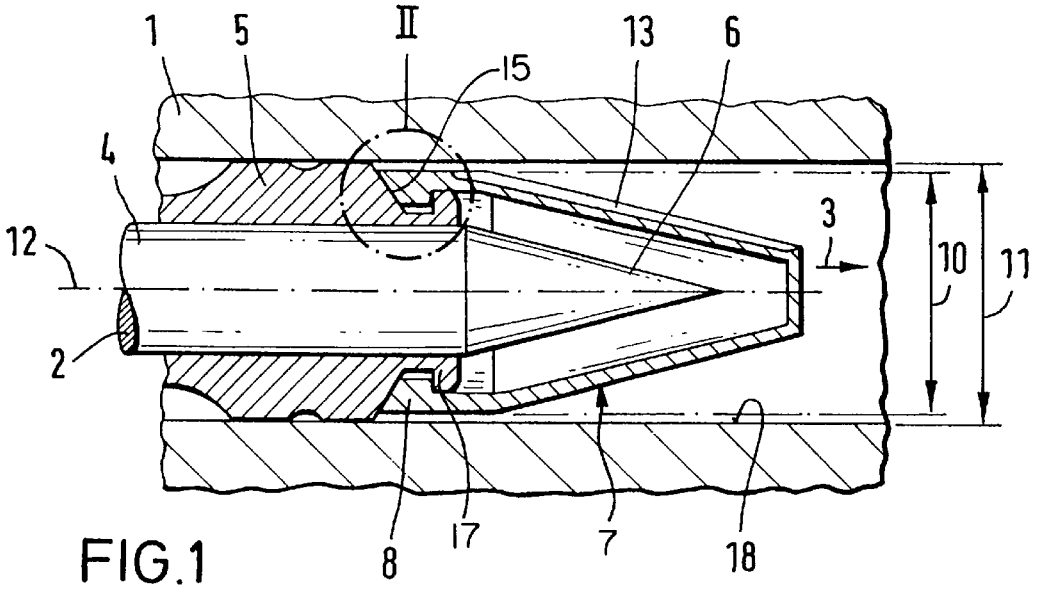
FIG. 1 is a longitudinal sectional view of the point region of a projectile with a feeding cap according to the invention, with the projectile being positioned in a weapon tube.

Referring now to FIG. 1, there is shown a segment 1 of a weapon tube wherein a subcaliber, fin-stabilized projectile 2 moves in the direction of arrow 3 toward the weapon tube muzzle, which is not shown. The projectile 2 essentially comprises a penetrator 4, a propelling cage 5 that surrounds at least a midportion of the penetrator 2 and that consists of several discardable or separatable segments, and a plastic feeding cap 7 that is joined or fastened to the propelling cage 5 at the front of the propelling cage and that is tapered toward the penetrator point 6.

The cap 7 has a base region 8 which extends over a reduced diameter portion 17 of the cap 7 disposed at the front end of the cap 5, and has an end surface 15 which abuts against an end surface 9 of the propelling cage 5, which surface 15 defines the end of the reduced diameter portion 17, to support the cap 7 in the axial direction. As shown, the end surface 9 is conically tapered in the forward direction of the projectile 2 by an angle 14 (FIG. 2) and is matingly engaged by the end surface 15 of the cap 7. Moreover, the diameter or caliber 10 of the cap 7 is less than the inner diameter or caliber 11 of the weapon tube 1, and thus less than the outer diameter or caliber of the propelling cage 5. The outer tapered surface of the cap 7 is provided with a plurality of groove-shaped predetermined break locations 13, only one of which is shown in the drawings, which extend in the direction of the longitudinal axis 12 of the projectile 2 and which are symmetrically distributed about the circumference of the cap 7. With the described arrangement, during the acceleration of projectile 2 inside weapon tube 1, the cap 7 is displaced axially in the direction of propelling cage 5 by the inertial forces, and due to the engagement of the conically tapered surfaces 9 an 15, results in an expansion in the diameter of the base region 8 of the cap 7.

Since the base region 8 of cap 7 has an outside diameter 10 that is smaller than the inside diameter 11 of the weapon tube 1 and since the outer surface of the cap 7 has several groove-shaped predetermined break locations 13 that extend in the direction of the longitudinal axis 12 of the projectile 2, the expansion of the base region 8 of cap 7 with a corresponding selected conical angle 14 (FIG. 2) of the end surface 9 of propelling cage 5, results in a cracking of the cap along the predetermined break locations 13.

Figure 3:
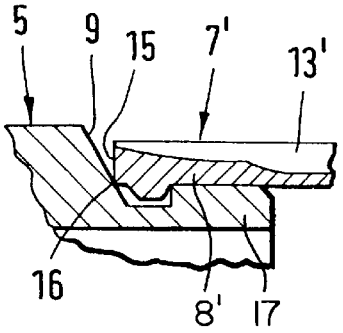
FIGS. 3 and 4 are respective detail views corresponding to FIG. 2 of additional embodiments of projectiles according to the invention.

Of course, the invention is not limited to the above-described embodiment. Thus, the end surface 15 of the cap 7 facing the surface 9 of the propelling cage 5 does not have to be a conical surface that is adapted to the end surface 9 of the propelling cage, but can have another shape as well. For example, according to a modification of the embodiment of FIG. 1 as shown in FIG. 3, the end surface 15' of the cap 7' facing the conically tapered end surface 9 of the propelling cage 5 is not conically or matingly tapered in the axial direction, but rather extends radially so that the cap 7' supports itself in the axial direction with its end surface 15' engaging the conically tapered end surface 9 of propelling cage 5 by way of a lower edge 16 of the surface 15'. As can be seen in FIG. 3, the predetermined break locations 13', in this embodiment, preferably additionally extend to the end surface 15', so that a relatively slight expansion of the base region 8' of cap 7' will already result in a cracking of the cap in the region of the predetermined break locations 13'.

Figure 4:
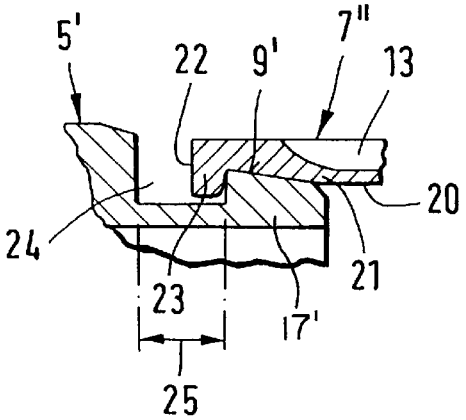

As can be seen in the further embodiment shown in FIG. 4, the cone-shaped surface of the propelling cage does not have to extend to the region of the tube inside wall 18 of the weapon tube as is shown in FIG. 1. Rather, the cone-shaped surface 9' of propelling cage 5' can also be arranged at the front end of the outer or circumferential surface of the reduced diameter portion 17' of the propelling cage 5' and a correspondingly tapered surface portion formed on the inside surface 20 of the jacket 21 of the cap 7". As further shown, the cap 7" has a fastening nub 23 at its rear end surface 22, which nub 23 extends or points inwardly toward the longitudinal axis 12 of the projectile 2 and which extends behind the cone-shaped surface 9' of the propelling cage 5' and engages in a corresponding groove-shaped recess 24 in the outer surface of the reduced diameter portion 17' of the propelling cage 5'. The width 25 of groove-shaped recess 24 is selected such that it permits an axial displacement of the cap 7" during the acceleration of the projectile in the weapon tube, which axial displacement is sufficient to cause a cracking of the cap 7" along the predetermined break locations 13 (or 13') through expansion of the base region 8" of the cap 7".

Figure 2:
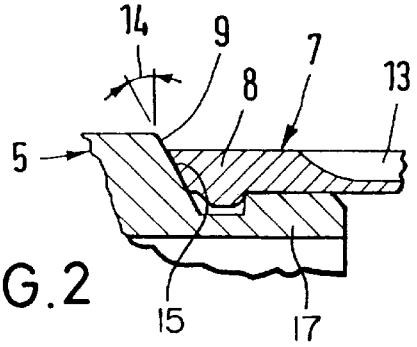
FIG. 2 is an enlarged detail view of the projectile region identified by reference II in FIG. 1.

As shown, the caps 7' and 7" of FIGS. 1–3 are also initially fastened to the front end of the respective propelling cage 5 by respective inwardly directed nubs on the inner surface of the jacket of the respective cap 7 or 7', which nubs engage in a corresponding recess in the outer or circumferential surface of the reduced diameter portion 17 of the propelling cage 5 adjacent the end surface 9.

The invention now being fully described, it will be apparent to one of ordinary skill in the art that many changes and modification can be made thereto without departing from the spirit or scope of the invention as set forth herein.

What is claimed:

1. A subcaliber projectile, comprising a penetrator having a pointed front end, a propelling cage that surrounds a midportion of the penetrator, and a cap which is tapered conically toward the penetrator point and which has a base region arranged on and surrounding a reduced diameter front portion of the propelling cage; and wherein:

the cap supports itself in its said base region on a conical surface of the propelling cage that is conically tapered in a direction toward the projectile point, such that during acceleration of the projectile inside a weapon tube from which the projectile is fired, the cap is displaced, as a result of the inertial force, in an axial direction toward the propelling cage, thereby causing an expansion of the diameter of the base region of the cap;

at least two groove-shaped predetermined break locations that extend in the direction of the longitudinal axis of the projectile are provided in an outer conical surface of the cap;

the base region of the cap has an outside diameter which is smaller than an outside diameter of the propelling cage and thus is smaller than an inside diameter of a weapon tube from which the projectile is to be fired; and, a conical angle of the conical surface of the propelling cage and the outside diameter of the base region of the cap are selected such that the expansion occurring in the base region of cap during acceleration of the projectile inside the weapon tube causes a cracking of the cap along the predetermined break locations.

2. A subcaliber projectile according to claim 1, wherein: the conical surface of the propelling cage is an end surface defining an end of the reduced diameter portion of the propelling cage; and the cap has an end surface that faces the propelling cage and supports the cap on the conical end surface of the propelling cage.

3. A subcaliber projectile according to claim 2, wherein the end surface of the cap that is facing the propelling cage is a conical surface that matingly engages the conical end surface of the propelling cage.

4. A subcaliber projectile according to claim 2 wherein the end surface of the cap facing the conical surface of the propelling cage extends radially and contacts the facing conical end surface of the propelling cage at a lower edge of the end surface of the cap.

5. A subcaliber projectile according to claim 1, wherein: the conical surface of the propelling cage is arranged on a circumferential surface of the reduced diameter portion of the propelling cage and engages a correspondingly tapered surface formed on an inner surface of the cap; a fastening nub that is directed toward the longitudinal axis of projectile is provided on the inner surface of the cap at its rear end; said nub extends behind the conical surface of the propelling cage and engages in a corresponding groove-shaped recess formed in an outer surface of the reduced diameter portion of the propelling cage; the width of the groove-shaped recess is such that during the acceleration of the projectile inside a weapon tube, an axial displacement of the cap can occur which is sufficient to cause cracking of the cap along the predetermined break locations as a result of the expansion of the base region of cap.

6. A subcaliber projectile according to claim 1, wherein the cap is made of plastic material.

7. A subcaliber projectile according to claim 1, wherein the predetermined break locations in the surface of the cap extend to a rear end surface of the cap that is facing the propelling cage.

8. A subcaliber projectile according to claim 1 wherein an inner surface of the cap in said base region is provided with an inwardly directed nub which engages in a groove formed in an outer surface of said reduced diameter portion of the propelling cage to fasten said cap to said propelling cage.

* * * * *